US006024543A

United States Patent [19]

Lambertson

[11] Patent Number: 6,024,543

[45] Date of Patent: Feb. 15, 2000

[54] BLOWER WHEEL HAVING INTERIOR MOTOR COOLING RIBS

[75] Inventor: Michael J. Lambertson, Thousand Oaks, Calif.

[73] Assignee: Zero Corporation, Los Angeles, Calif.

[21] Appl. No.: 08/965,791

[22] Filed: Nov. 7, 1997

[51] Int. Cl.[7] ..... F04B 39/06

[52] U.S. Cl. ..... 417/366; 417/423.14; 416/203; 416/175

[58] Field of Search ..... 417/354, 356, 417/423.14; 416/175, 185, 186 R, 203

[56] References Cited

U.S. PATENT DOCUMENTS

| | | | |
|---|---|---|---|
| 2,251,807 | 8/1941 | Ruthman | 417/423.14 |
| 3,885,888 | 5/1975 | Warhol | 416/203 |
| 4,306,838 | 12/1981 | Trainer . | |
| 4,647,271 | 3/1987 | Nagai et al. | 416/188 |
| 5,554,004 | 9/1996 | Steward . | |
| 5,893,705 | 4/1999 | Khan et al. | 417/354 |

FOREIGN PATENT DOCUMENTS

| | | | |
|---|---|---|---|
| 542232 | 6/1957 | Canada | 416/203 |
| 2062534 | 3/1972 | Germany | 416/175 |
| 2223539 | 4/1990 | United Kingdom . | |

OTHER PUBLICATIONS

McLean Engineering, Capability Introduction Brochure, cover and 1 page.

EBM/PAPST, Backward Curved AC Impellers Brochure, cover and pages 65 and 136 (1995).

Continental Fan Mfg., Inc., CK Series Brochure, cover and 1 page.

*Primary Examiner*—Timothy S. Thorpe
*Assistant Examiner*—Cheryl J. Tyler
*Attorney, Agent, or Firm*—Quarles & Brady LLP

[57] ABSTRACT

A blower wheel for an electric motor driven fan includes an impeller in concentric alignment with a back plate. The back plate has an interior sleeve with a plurality of inwardly directed ribs that define a motor receiving circle in which a motor is disposed. Gaps between the ribs form a cooling shroud about a motor rotor such that when the blower wheel is rotated the plurality of ribs force high velocity air through the gaps and over the outside surface of the rotor. The blower also includes a shroud positioned about the blower wheel and motor having inlet and outlet air openings.

8 Claims, 3 Drawing Sheets

FIG. 4
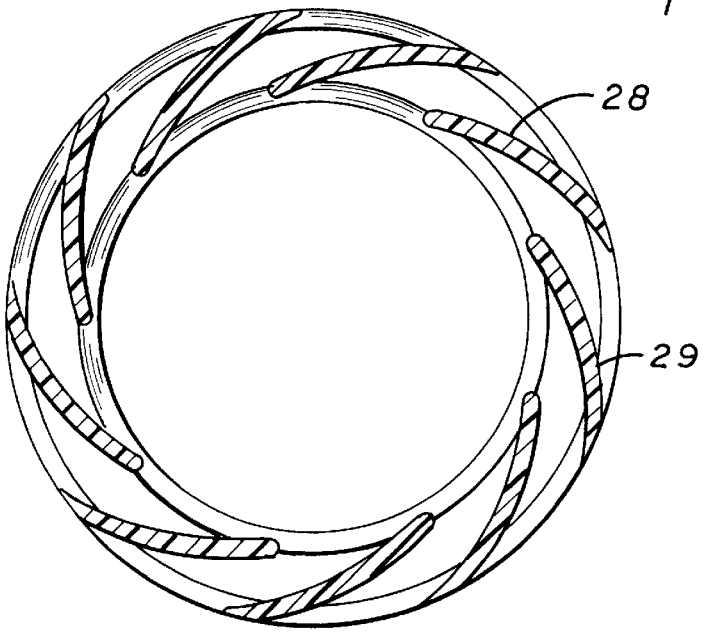
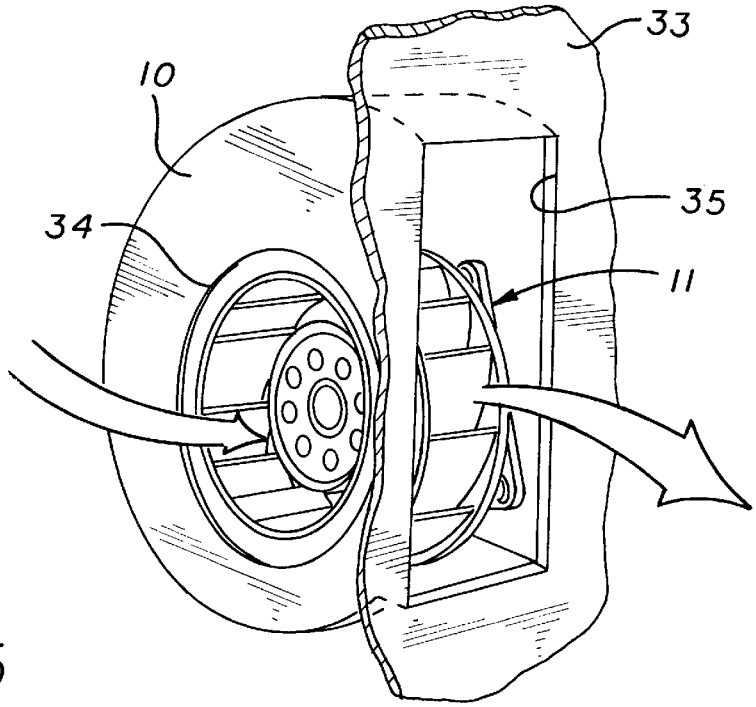
FIG. 5

BLOWER WHEEL HAVING INTERIOR MOTOR COOLING RIBS

BACKGROUND OF THE INVENTION

This invention relates to blower wheels and to motor-blower wheel combinations to form a blower. Blowers have been widely used in many forms for many years. One current use is in housings for electronic products, including small computers and similar items. There is a continuous need for smaller products with higher capacities, while at the same time being lighter in weight, durable, quieter and less expensive.

In a typical blower, a blower wheel is mounted on an electric motor and positioned within a shroud for directing air flow to and from the blower wheel. A typical blower wheel comprises a plurality of blades carried on a rotating motor placed in some form of housing.

Presently known blower wheels are relatively large for a given output capacity. It is desirable to maintain high output capacity but reduce the overall size of the blower and cooling system to minimize costs associated with the system packaging and allow for smaller electronic systems and computers. Presently known blower wheels are constructed using steel or aluminum sheet metal or a combination of steel or aluminum and plastic which use a variety of techniques including slots, tabs, staked pins, or rivets to join the components. This type of construction can allow relative movement between the blade components and the back plate or leave small air gaps between wheel components. This movement or existence of small air gaps can cause excessive noise. Other known blower wheels using all metal construction use a welded joint, however this type of construction is expensive and results in a relatively heavy finished product. Presently known blower wheels using plastic/metal construction are typically joined using small plastic pins projecting from the blades through the back plate which are then staked to secure the parts together. These pins are relatively fragile and when damaged can lead to structural failure or additional relative movement between the parts which can cause excessive noise.

It is an object of the present invention to provide a new and improved blower wheel design which will overcome such disadvantages, and which will be lighter in weight, less expensive, and more durable than the prior art designs, and also which will provide more output for the same size and power consumption of prior units.

SUMMARY OF THE INVENTION

The preferred embodiment of the invention includes a blower wheel for an electric motor driven fan, the blower wheel having an axis of rotation and including a back plate and an impeller, with the back plate having a first annular disc and an interior sleeve integral with the first disc, and with the interior sleeve having an outer ring and a plurality of inwardly directed ribs defining a motor receiving circle. When assembled with the rotor, the inwardly directed ribs form an integral cooling shroud and air gap that when rotated, forces high velocity airflow through the air gap and over the outside surface of the rotor. The impeller has a second annular disc and a plurality of blades carried on the second disc and projecting parallel to the axis of rotation, with the back plate and impeller joined together in concentric alignment.

Desirably, the back plate and the impeller have interengaging means for joining the back plate and impeller together, typically including a plurality of pins carried in the blades opposite the second disc, and a plurality of openings in the first disc, with the pins positionable in the openings to provide concentric alignment when the back plate and impeller are brought together.

Preferably, the back plate and impeller are fabricated from injection molded plastic and the impeller blades include an energy directing projection on the blade surface opposite the inlet disc that when brought together with at textured surface on the top surface of the back plate can be joined together, typically by ultrasonic welding, to form a homogeneous high strength joint.

The invention also includes a blower comprising a motor and a blower wheel with the motor having a stator carried on a mounting plate and a rotor positioned around the stator and with the motor rotor positioned in the motor receiving circle of the ribs of the blower wheel.

BRIEF DESCRIPTION OF THE DRAWINGS

FIG. 4 is a sectional view taken along the line 4—4 of FIG. 3; and

FIG. 5 is a view of the blower of FIG. 1 mounted on a wall, illustrating operation of the blower.

DESCRIPTION OF THE PREFERRED EMBODIMENT

Figure 1:
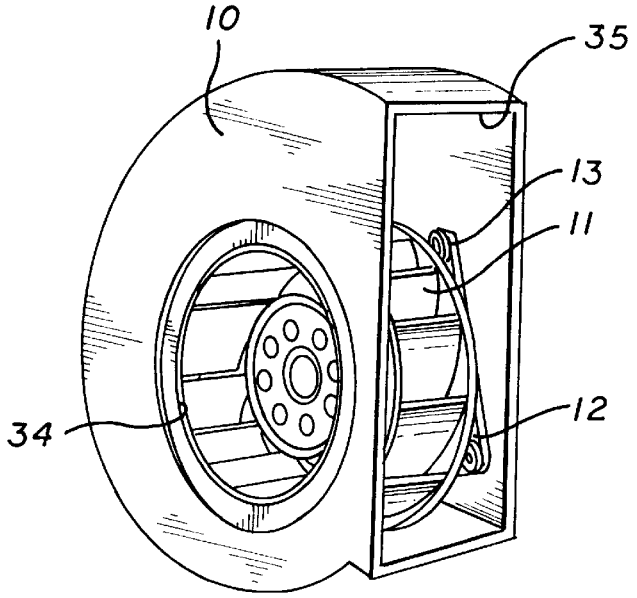
FIG. 1 is a perspective view of a blower incorporating the blower wheel of the invention.
Figure 3:
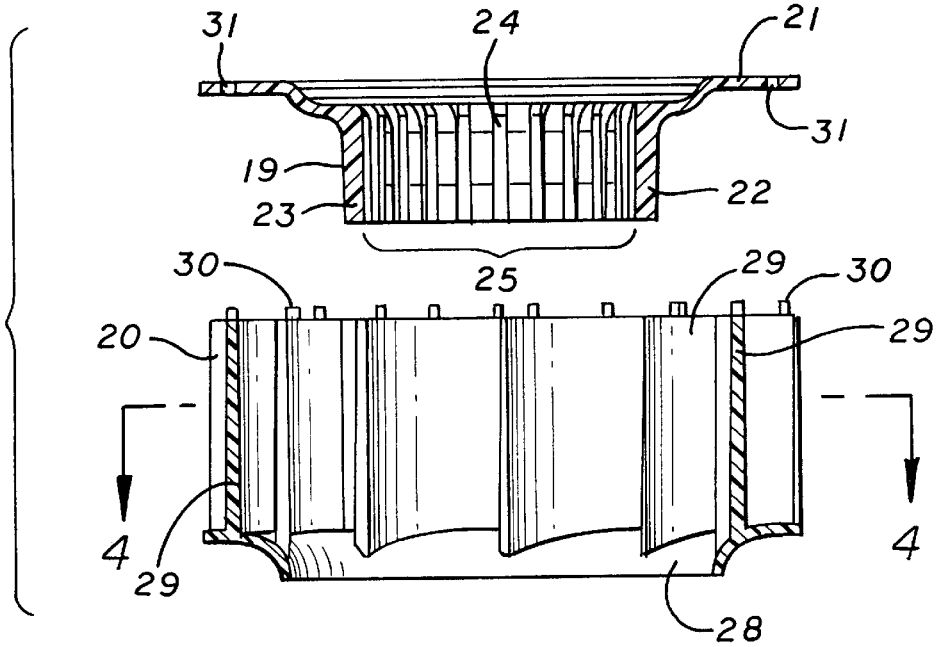
FIG. 3 is an exploded view of the blower wheel showing the back plate and impeller.
Figure 2:
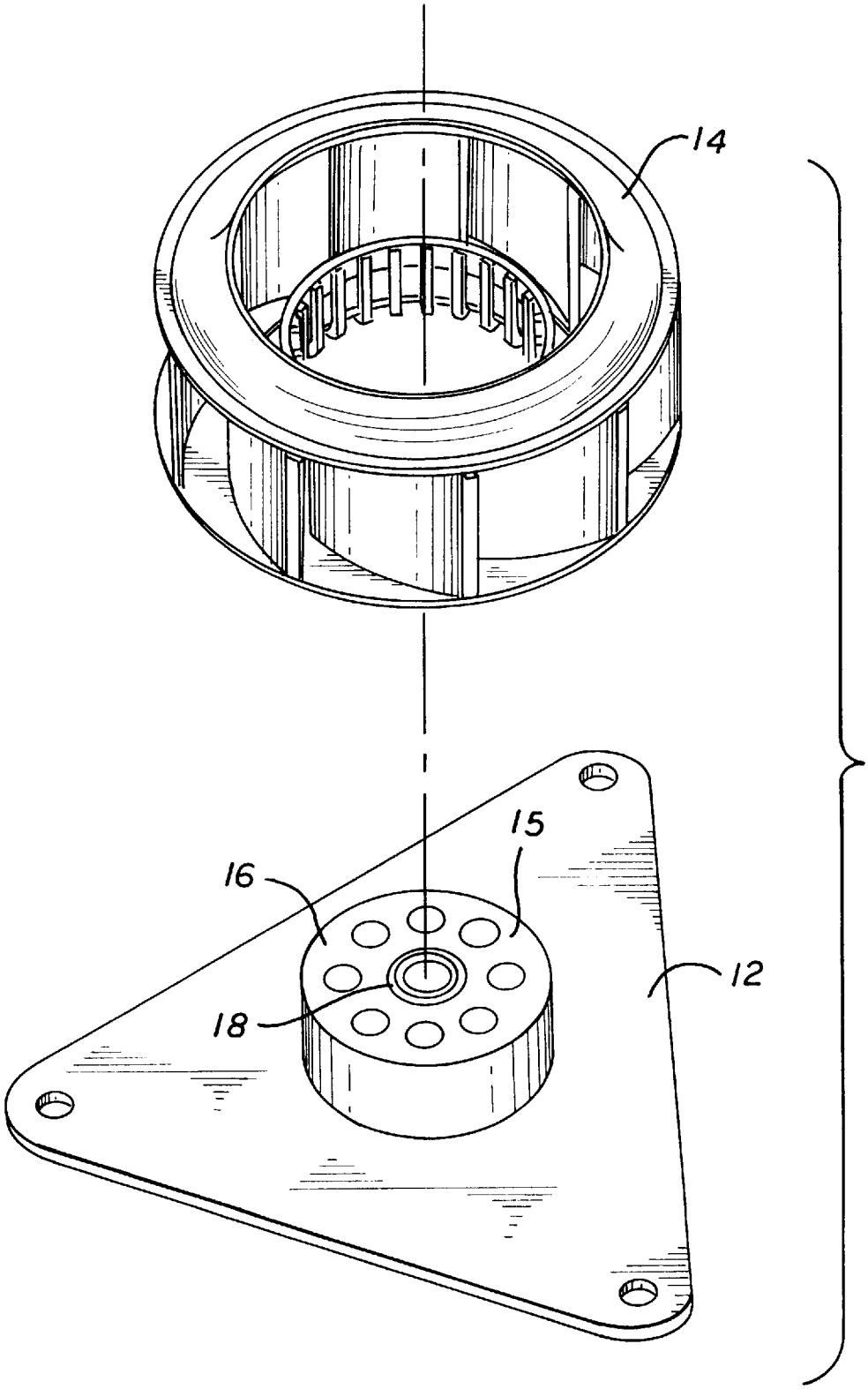
FIG. 2 is an exploded view of the blower of FIG. 1 showing the blower wheel and motor mount.

In FIG. 1, a shroud 10 is positioned around a blower 11, with the shroud attached to the blower at a motor mounting support plate 12 by conventional mounting means such as screws or rivets 13. The blower 11 includes a blower wheel 14 and a motor 15, with the motor mounted on the support plate 12. The motor 15 may be conventional in construction, with a stator (18) carried on the support plate 12 and with a rotor 16 positioned around the stator.

The blower 11 includes a back plate 19 and an impeller 20, with these two components joined together in concentric alignment. The back plate 19 has an annular disc 21 and an interior sleeve 22 integral with the disc, preferably formed by plastic molding. The interior sleeve 22 has an outer ring 23 with a plurality of inwardly directed ribs 24. The ribs 24 are spaced from each other and are inwardly directed to define a motor receiving circle 25. The diameter of this circle 25 is selected for the specific motor utilized, so that the rotor 16 of the motor is a press fit into the motor receiving circle of the back plate.

The impeller 20 has an annular disc 28 carrying a plurality of blades 29, which blades project parallel to the axis of rotation of the blower wheel and motor rotor, in the conventional manner. The back plate 19 is positioned on the impeller 20, with the disc 21 resting on the exposed edges of the blades 29 to form the completed blower wheel 14. The back plate and impeller are joined together, typically by ultrasonic welding. Preferably, a plurality of pins 30 are provided on the exposed edges of the blades 19 and fit into alignment openings 31 of the disc 21 of the back plate. When assembled with the rotor, the inwardly directed ribs form an integral cooling shroud and air gap that when rotated, forces high velocity airflow through the air gap and over the outside surface of the rotor.

Usually, the blower is manufactured with the blower wheel, motor and support plate as a unit and delivered to the customer ready for installation and electrical connection. The shroud may be attached to the support plate and delivered with the blower. Alternatively, the shroud may be formed with the product to be cooled, with the support plate attached to the product.

In FIG. 5, the blower 11 is shown mounted in the shroud 10, on a wall 33 of a housing or the like. The shroud has an inlet opening 34 providing for air flow into the interior of the impeller, and an outlet opening 35 positioned at a corresponding opening in the wall plate 33, for air flow outward from the blower.

The unique construction of the blower wheel of the present invention with the inwardly directed ribs provides an integral air gap and cooling shroud for the motor rotor.

The blower wheel when rotated, forces high velocity airflow through this air gap and over the outside surface of the rotor. This airflow reduces the operating temperature of the motor and allows the use of a smaller motor to provide the same output capacity as a larger motor not using the technique, especially when both motors are limited to a given maximum temperature rise. Also, the construction results in a quieter blower as compared to a blower of comparable size and output capacity using all metal or metal/plastic construction.

I claim:

1. A blower wheel for an electric motor driven fan, said blower wheel having an axis of rotation and including a back plate and an impeller, said back plate having a first annular disk and an interior sleeve integral with said first disc, said interior sleeve having an outer ring with an inner surface from which a plurality of inwardly directed ribs extend to define a motor receiving circle, said ribs also defining a plurality of gaps containing air that is directed at the periphery of said motor receiving circle when said blower wheel rotates about said axis of rotation, said impeller having a second annular disc and a plurality of blades carried on said second disc and projecting parallel to said axis of rotation, said back plate and said impeller being joined together in concentric alignment.

2. A blower wheel as defined in claim 1 with said back plate and said impeller having interengaging means for joining said back plate and impeller together.

3. A blower wheel as defined in claim 2 wherein said means for joining includes a plurality of pins carried in said blades opposite said second disc, and a plurality of openings in said first disc, with said pins positionable in said openings when said back plate and impeller are brought together.

4. A blower wheel as defined in claim 3 with said impeller blades ultrasonically welded to said back plate first disc.

5. A blower wheel as defined in claim 1 with said impeller blades ultrasonically welded to said back plate first disc.

6. A blower comprising a motor and a blower wheel, said motor having a stator carried on a mounting plate and a rotor positioned around said stator, said blower wheel having an axis of rotation and including a back plate and an impeller, said back plate having a first annular disk and an interior sleeve molded integrally with said first disc, said interior sleeve having an outer ring with an inner surface from which a plurality of inwardly directed ribs extend to define a motor receiving circle in which the ribs are in fixed, abutting relation with the rotor, said ribs also defining a plurality of gaps containing air that is directed at the periphery of said rotor when said blower wheel rotates about said axis of rotation, said impeller having a second annular disc and a plurality of blades carried on said second disc and projecting parallel to said axis of rotation, said back plate and said impeller being joined together in concentric alignment.

7. A blower as defined in claim 6 with said impeller blades of said wheel ultrasonically welded to said backplate first disc.

8. A blower as defined in claim 7 including an exterior shroud positioned about said blower wheel and motor, said shroud having an inlet opening at said impeller second disc into the interior of the shroud between said blades and said motor rotor, and an outlet opening at a plurality of said blades outer ends.

* * * * *